US011728572B1

(12) United States Patent
Dressel

(10) Patent No.: US 11,728,572 B1
(45) Date of Patent: Aug. 15, 2023

(54) TWISTARRAY REFLECTOR FOR AXISYMMETRIC INCIDENT FIELDS

(71) Applicant: Raytheon Company, Waltham, MA (US)

(72) Inventor: Earl M. Dressel, Albuquerque, NM (US)

(73) Assignee: Raytheon Company, Waltham, MA (US)

( * ) Notice: Subject to any disclaimer, the term of this patent is extended or adjusted under 35 U.S.C. 154(b) by 62 days.

(21) Appl. No.: 17/118,053

(22) Filed: Dec. 10, 2020

Related U.S. Application Data

(60) Provisional application No. 62/946,470, filed on Dec. 11, 2019, provisional application No. 62/946,461, filed on Dec. 11, 2019.

(51) Int. Cl.
*H01Q 15/24* (2006.01)
*H01Q 15/22* (2006.01)
*H01Q 19/19* (2006.01)

(52) U.S. Cl.
CPC ..... *H01Q 15/248* (2013.01); *H01Q 15/22* (2013.01); *H01Q 19/19* (2013.01)

(58) Field of Classification Search
CPC ..... H01Q 15/22; H01Q 15/248; H01Q 19/195
See application file for complete search history.

(56) References Cited

U.S. PATENT DOCUMENTS 4,220,957 A * 9/1980 Britt ..... H01Q 19/065 343/756
4,757,323 A * 7/1988 Duret ..... H01Q 25/001 343/756
5,440,320 A * 8/1995 Lach ..... H01Q 15/147 343/915
6,404,399 B1 * 6/2002 Morita ..... H01Q 3/20 343/757
2004/0056823 A1 * 3/2004 Zuk ..... G06K 19/07749 343/895

OTHER PUBLICATIONS

V. G. Borkar, V. M. Pandharipande and R. Ethiraj, "Millimeter wave twist reflector design aspects," in IEEE Transactions on Antennas and Propagation, vol. 40, No. 11, pp. 1423-1426, Nov. 1992, doi: 10.1109/8.202720. (Year: 1992).*
Antenna Theory: A Review, Balanis, Proc. IEEE vol. 80 No. 1 Jan. 1992 (Year: 1992).*

* cited by examiner

*Primary Examiner* — Andrea Lindgren Baltzell
*Assistant Examiner* — Amal Patel
(74) *Attorney, Agent, or Firm* — Daly Crowley Mofford & Durkee, LLP

(57) ABSTRACT

A twistarray reflector includes: a reflector having front reflecting surface comprising wires and a back reflecting surface, the front reflecting surface fabricated from the wires and composites where the wires are placed having an orientation at each point on the front surface to decompose an incident field into orthogonal components so that an electromagnetic reflected from the front surface when superposed with a phase-inverted electromagnetic field reflected from the back reflecting surface produces a net reflected electromagnetic field that is polarized in a specific vector direction with consistent phase.

16 Claims, 8 Drawing Sheets

TWISTARRAY REFLECTOR FOR AXISYMMETRIC INCIDENT FIELDS

CROSS-REFERENCE TO RELATED APPLICATIONS

This application claims priority from U.S. Provisional application Ser. No. 62/946,461 filed on Dec. 11, 2019 and U.S. Provisional application Ser. No. 62/946,470 filed on Dec. 11, 2019, both of which are incorporated herein by reference.

STATEMENT REGARDING FEDERALLY SPONSORED RESEARCH

Not Applicable.

FIELD

This disclosure relates generally to radio frequency transmitting and receiving systems, and, more particularly, to a twistarray reflector antenna and a variable twistarray reflector antenna.

BACKGROUND

Electromagnetic (EM) fields in free space, propagate as a transverse wave, with the direction of travel perpendicular to the fields. FIG. 1 shows the EM fields propagating in a linearly-polarized transverse wave. The E- and H-field vectors of a propagating plane wave lie in a plane normal to the direction of propagation, as shown in FIG. 1. The net E- or H-field at any point in space is the linear superposition of the fields impinging on that point. FIG. 1A shows linear superposition (or decomposition) of a field vector from (to) components aligned with arbitrarily-oriented orthogonal basis vectors. Because E- and H-fields are vectors, they can be described as (decomposed into) a linear superposition of component weights on orthonormal basis directions (e.g., coordinate axes), as shown in FIG. 1A. The polarization of the propagating wave describes the time varying behavior of the amplitude and direction of the E-field vector ($\vec{E}$ in FIG. 1A).

A well-known and effective polarization filter in the microwave regime is an array of parallel wires. Incident E-fields propagating parallel to the wires are perturbed and induce current in the wires such that reflection of the incident wave occurs. Incident E-fields perpendicular to the wires do not interact with the wires as long as the wire diameters are small compared to the wavelength, and transmit through the array without change. The quality of the filter (the polarization purity) depends on 1) the density of the wires (higher density is better) and 2) the diameter of the wires (smaller is better) relative to the wavelength.

An ordinary twistarray reflector is a planar array of parallel wires suspended over a planar reflective back plane. The wire array decomposes a linearly polarized incident field into orthogonal components: the component polarized parallel to the wires reflects from the wire array, whereas the component polarized perpendicular to the wires reflects from the back plane. The difference in propagation path length between fields reflected from the wires and fields reflected from the back plane introduces a phase delay between orthogonal components of the reflected field. When the orientation of the wires relative to the polarization of the incident wave decomposes the EM-field into equal components, and the difference in propagation path length introduces a phase delay of the EM fields reflected from the back plate relative to the phase of fields reflected from the wire array is one-half of a full cycle at the frequency of the incident wave, then the polarization of the superposed reflected wave is "twisted" by 90° relative to what the reflected wave would have had if it were reflected from a planar conductor alone. Thus, to achieve a 90° twist in the polarization of a normally-incident, linearly polarized wave, the parallel wires in an ordinary twistarray reflector are arranged at an angle of 45° relative to the linearly-polarized incident EM field, as shown in FIG. 2. FIG. 2 shows decomposition of an E-field (green) normally-incident to an ordinary twistarray reflector into orthogonal components reflected from the front and back planes.

SUMMARY

The present disclosure teaches a twistarray reflector comprising: a reflector having a front surface comprising wires and a back reflecting surface, the front reflecting surface fabricated from the wires and composites where the wires are placed having an orientation at each point on the front surface to decompose an incident field into orthogonal components so that an electromagnetic field reflected from the front surface when superposed with a phase-inverted electromagnetic field reflected from the back reflecting surface produces a net reflected electromagnetic field that is polarized in a specific vector direction with consistent phase.

The present disclosure also teaches a variable twistarray reflector comprising: a reflector having front reflecting surface comprising moveable wires and a back reflecting surface, the front reflecting surface fabricated from the moveable wires and disposed on composites where the moveable wires are placed having an orientation at each point on the front surface to decompose an incident field into orthogonal components so that an electromagnetic reflected from the front surface when superposed with a phase-inverted electromagnetic field reflected from the back reflecting surface produces a net reflected electromagnetic field that is polarized in a specific vector direction with consistent phase.

BRIEF DESCRIPTION OF THE DRAWINGS

The foregoing features may be more fully understood from the following description of the drawings. The drawings aid in explaining and understanding the disclosed technology. Since it is often impractical or impossible to illustrate and describe every possible embodiment, the provided figures depict one or more illustrative embodiments. Accordingly, the figures are not intended to limit the scope of the broad concepts, systems and techniques described herein. Like numbers in the figures denote like elements.

DETAILED DESCRIPTION

Figure 1A:
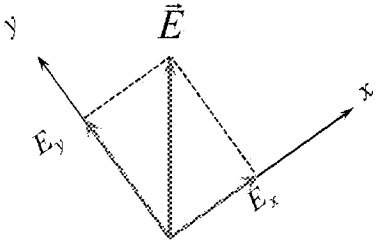
FIG. 1A Prior Art
FIG. 1A shows linear superposition (or decomposition) of a field vector from (to) components aligned with arbitrarily-oriented orthogonal basis vectors.
Figure 1:
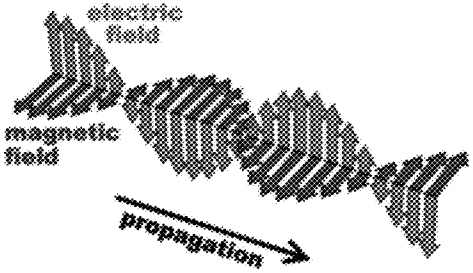
FIG. 1 Prior Art
FIG. 1 shows the EM fields propagating in a linearly-polarized transverse wave.
Figure 2:
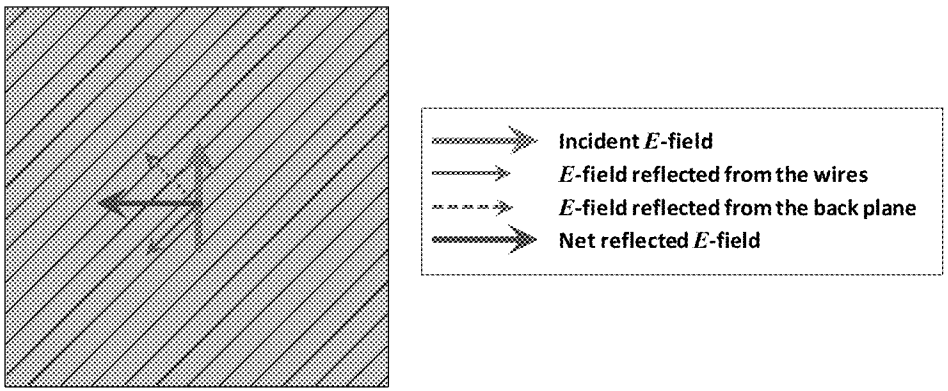
FIG. 2 Prior Art
FIG. 2 shows decomposition of an E-field (green) normally-incident to an ordinary twistarray reflector into orthogonal components reflected from the front and back planes.

The features and other details of the disclosure will now be more particularly described. It will be understood that any specific embodiments described herein are shown by way of illustration and not as limitations of the concepts, systems and techniques described herein. The principal features of this disclosure can be employed in various embodiments without departing from the scope of the concepts sought to be protected.

The disclosure relates to methods and apparatus for a twistarray reflector capable of inverting an incident axisymmetric electromagnetic (EM) field distribution to its dual form.

Specifically, the disclosed embodiment transforms a radiated axisymmetric TEN circular EM-field distribution to the form of a radiated axisymmetric $TM_{01}$ circular EM-field distribution, and vice versa. The disclosed embodiment can handle extremely high power, making it suitable for high-power microwave (HPM) applications.

As to be described, a Twistarray Reflector for Axisymmetric Incident Fields generalizes the vector decomposition concept behind the ordinary twistarray reflector from straight wires in a uniform and uniformly linear polarized EM field to curving wires in a non-uniform and non-uniformly polarized EM field. At every point on the wire-array reflector surface, the wire path is treated as a continuous function that can be manipulated mathematically to produce a particular effect. For an incident axisymmetric EM-field distribution of polarizations (either TE or TM), the wire paths are chosen so that the reflected distribution is the EM dual of the polarization distribution that would have occurred (TM or TE) if the incident polarization distribution had been reflected by the conductive back plane alone.

The disclosure also relates to methods and apparatus for a variable twistarray reflector capable of altering the polarization of an incident axisymmetric electromagnetic (EM) field distribution to any elliptical polarization at each point in the EM distribution. Specific cases of interest are: 1) reproducing the original axisymmetric polarization distribution about the reflected direction, 2) the EM dual of this polarization distribution, and 3) circular polarization of either chirality. Specifically, the disclosed embodiment transforms a radiated axisymmetric TEN circular EM-field distribution to the form of a radiated axisymmetric $TM_{01}$ circular EM-field distribution, and vice versa, and any elliptical polarization in between, including circular polarization. Additionally, the disclosed embodiments can rapidly adapt to any narrowband frequency over an ultrawideband range of frequencies. The disclosed embodiment can handle extremely high power, making it suitable for high-power microwave (HPM) applications.

As to be described, a Variable Twistarray Reflector for Axisymmetric Incident Fields leverages the concepts of an ordinary twistarray reflector, but extends them in two different ways. First, at every point on the wire-array reflector surface, the wire path is treated as a continuous function that can be manipulated mathematically to produce a particular effect. For an incident axisymmetric EM-field distribution of polarizations (either TE or TM), the wire paths are chosen so that the reflected distribution is the EM dual of the polarization distribution that would have occurred (TM or TE) if the incident polarization distribution had been reflected by the conductive back plane alone. Secondly, the Variable Twistarray Reflector for Axisymmetric Incident Fields provides the ability to dynamically vary the spacing between the front-surface wire array and back-surface conducting sheet. As the difference in path length increases from zero, the phase delay of fields reflected from the back plane increases relative to the phase of fields reflected from the wire array, so that the polarization of the recombined reflected EM field at each point changes successively from:

Right or left circular ($\Delta\psi_{delay}=-\tau/4+n\tau$), to

Linear co-polarized with the incident field ($\Delta\psi_{delay}=n\tau$) to

Left or right circular ($\Delta\psi_{delay}=\tau/4+n\tau$) to

Linear cross-polarized with the incident field ($\Delta\psi_{delay}=\tau/2+n\tau$)

repeating cyclically for n=0, 1, 2, . . . , where $\tau=2\pi$ (one wave cycle per $\tau$ radians). The spatial distance corresponding to the phase delay depends on the wavelength, hence frequency. Consequently, the capability to dynamically vary the spacing between the wire array and the back plane also gives the Variable Twistarray Reflector for Axisymmetric Incident Fields the capability to achieve any polarization at each point over any bandwidth for which the traces remain dense enough for the highest frequency in the band of interest.

Figure 3:
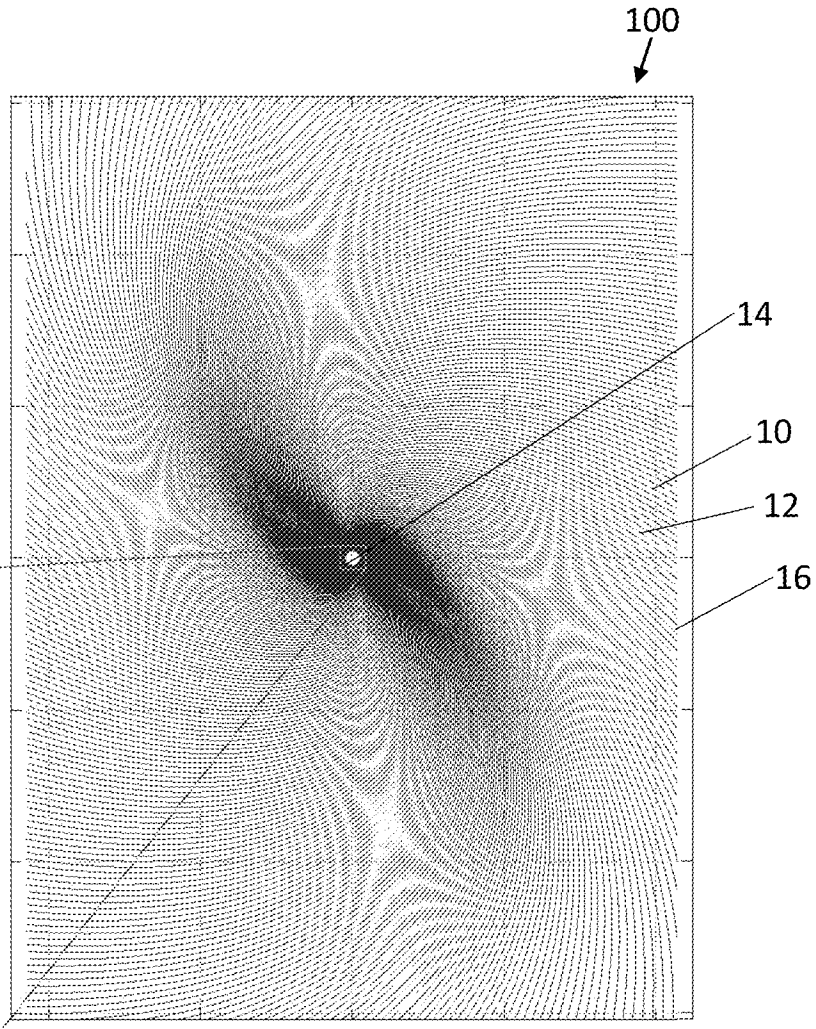
FIG. 3 shows a twistarray reflector for axisymmetric incident fields.

Referring now to FIG. 3, a twistarray reflector 100 is shown. As mentioned above, this disclosure relates to methods and apparatus for a twistarray reflector capable of inverting an incident axisymmetric electromagnetic (EM) field distribution to its dual form. Specifically, the embodiment transforms a radiated axisymmetric TEN circular EM-field distribution to the form of a radiated axisymmetric $TM_{01}$ circular EM-field distribution, and vice versa. The disclosure can handle extremely high power, making it suitable for high-power microwave (HPM) applications. The twistarray reflector 100 for axisymmetric incident fields generalizes the vector decomposition concept behind the ordinary twistarray reflector from straight wires in a uniform, uniformly polarized EM field to curving wires in a non-uniform, non-uniformly polarized EM field. At every point on the wire-array reflector surface, a wire path 10 is treated as a continuous function that can be manipulated mathematically to produce a particular effect. For an incident axisymmetric EM-field distribution (either TE or TM), the wire paths 10 are chosen so that the reflected distribution is the EM dual of the polarization distribution that would have occurred (TM or TE) if the incident polarization distribution had been reflected by the conductive back plane alone.

Figure 3A:
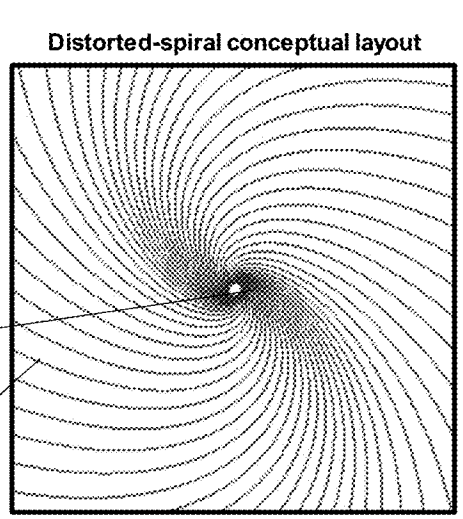
FIG. 3A shows trace paths in a distorted-spiral enlarged view of a layout of wire paths extending from an outer periphery to an inner ring of a twistarray reflector.
Figure 3B:
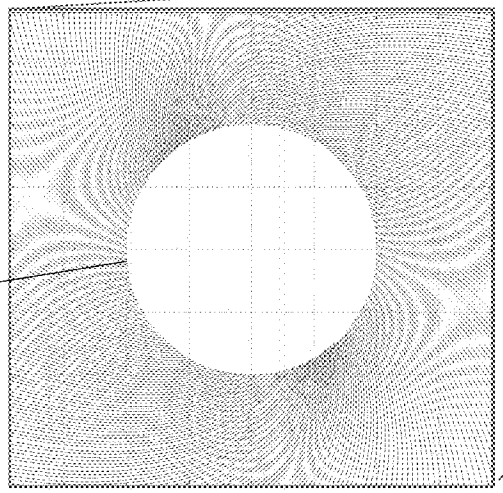
FIG. 3B shows an enlarged view of the inner ring of the twistarray reflector.

Referring now also to FIGS. 3A and 3B, the twistarray reflector 100 is based on the conceptual physics that underpins an ordinary twistarray reflector but extends these concepts to a different design format and applies the concepts in a manner not formerly considered for legacy twistarray reflectors. In the twistarray reflector 100, the simple format of constraining wires to parallel straight lines is replaced by the concept of aligning the wires with the streamlines of the abstracted wire-direction mathematical vector field. This wire-direction vector field is the mathematical solution that results from directly imposing the following requirement on reflected EM fields:

Choose a wire orientation at each point on the front reflecting surface that decomposes the incident field into orthogonal components so that the EM field reflected from the front surface, when superposed with the phase-inverted EM field reflected from the back surface, produces a net reflected EM field that is polarized orthogonal to the EM field that would have been reflected by the back surface alone.

In the particular case of an axisymmetric incident EM field distribution, the abstract wire-direction vector field is conveniently described as a continuous function of cylindrical-polar coordinates, implying that the stream lines curve over the reflector surface in paths that vary with radius and azimuth. Wires 10 forming the wire array in this wire-direction vector field construction may be placed anywhere on the surface, but once any point on a wire path is designated, the wire path must follow that stream line in the wire-direction vector field.

One embodiment of a twistarray reflector 100, designed for non-normal incidence, has been implemented in hardware and has been demonstrated to function electromagnetically as intended. The raw conceptual wire paths in this embodiment are shown as a 2D graph in FIG. 3. FIG. 3 shows trace paths 10 of an Axisymmetric Twistarray Reflector 100 according to the disclosure. FIG. 3A shows trace paths 10 in a distorted-spiral enlarged view of a layout of wire paths 10 extending from an outer periphery to an inner ring 14 of a twistarray reflector 100. FIG. 3B shows an enlarged view of the inner ring 14 of the twistarray reflector 100. A line 12 identifies the path of a single trace (same trace is marked in the full and enlarged views). Trace paths (wires) 10 of the twistarray reflector 100 extend from an outer periphery 16 to an inner ring 14. Determining the conceptual wire path is the first step to creating a physical instantiation of a twistarray reflector 100 for axisymmetric incident fields. To construct conductive circuit-board traces (the wires) on the conceptual paths, the following additional information must be provided:

1. Each conceptual trace path is bounded by a continuous curve on either side to demarcate a metal trace of finite width, with the conceptual trace path nominally centered between these boundaries.
2. The width-to-separation ratio of all traces must remain nearly constant over all resolutions.
3. The trace width cannot anywhere become thinner than the minimum trace width specified by the circuit board fabricator.
4. Spacing between successive traces should not exceed $\lambda/10$ at the highest frequency of the operational band in any region of significant illumination by the incident beam.
5. The sequence of points describing each trace must form a closed path in the circuit board plane so that the fabrication software understands the point cloud as a trace.
6. The sampling resolution must be sufficient to accurately represent the curving trace boundaries without introducing spurious gaps or thinning of the trace width in any region due to inaccurate interpolation. 7. Trace tips approaching the axisymmetric center are shorted together in a center ring to preclude E-field-induced breakdown from charge accumulating at the ends of the traces.
8. Trace tips at the outer edge are terminated with a region of enhanced radius to mitigate field-induced breakdown from charge accumulating at the tips.

Figures 4, 4A, 4B, 4C:
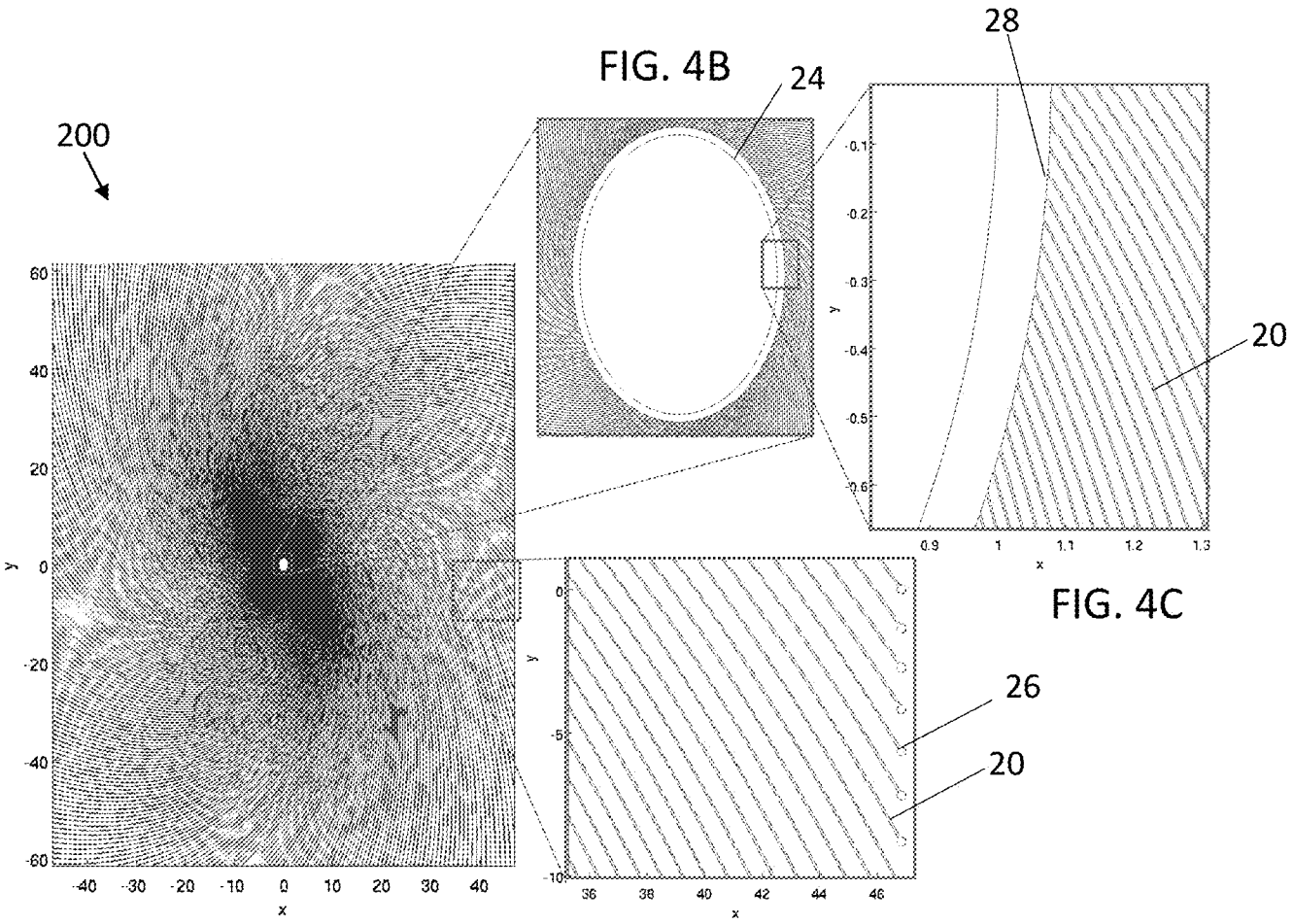
FIG. 4 shows a plot of the point clouds specifying the trace boundaries of the twistarray reflector.
FIG. 4A shows enhanced-radius tips of the traces of the twistarray reflector.
FIG. 4B shows an enhanced view of the connecting conducting inner ring.
FIG. 4C shows an enhanced view of the inner ends of the traces of the twistarray reflector.

These features are illustrated in FIG. 4 for a similar embodiment of a twistarray reflector 200. The shape of an inner ring 24 is elliptical because in this case the reflector 200 lies at constant 45° slope relative to the axisymmetric beam. Notice that the traces 20 are functionally self-similar at all locations and size scales. The mathematical description and the numerical manipulations required to generate these trace paths for non-normal incidence are non-trivial. To handle the huge range of resolutions required, the sampling density of points used to resolve each trace path is determined by the local curvature of the conceptual wire path locating the trace. FIG. 4 shows a plot of the point clouds specifying the trace boundaries of the twistarray reflector 200, here an Axisymmetric Twistarray Reflector 200, used to create the specification file for fabrication. Successive levels of magnification of inner and outer regions of FIG. 4 show the connecting conducting inner ring 24 and the inner ends 28 of the traces 20 (also referred to as wire paths 20) (FIGS. 4B and 4C) and the enhanced-radius tips 26 of the traces 20 (FIG. 4A). These trace details inhibit E-field-induced breakdown at the inner and outer ends of the continuous conductive paths formed by the traces 20. The fixed separation distance of between the wire array surface and the backplane surface is provided by a low-index foam. For proper operation of the assembly, the phase delay introduced by the dielectric properties of the trace substrate and of the foam must be taken into account in assigning the thickness of the foam.

Figure 5A:
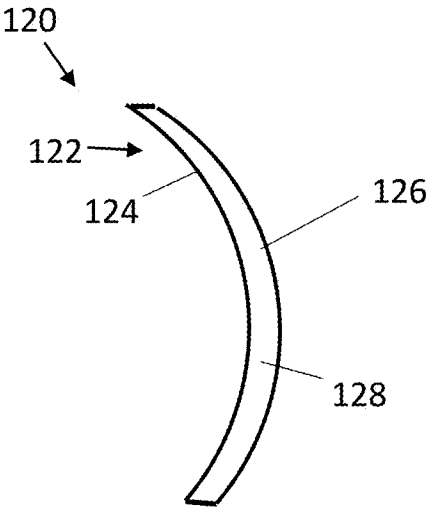
FIG. 5A shows a curved panel arrangement of the twistarray reflector.
Figure 5:
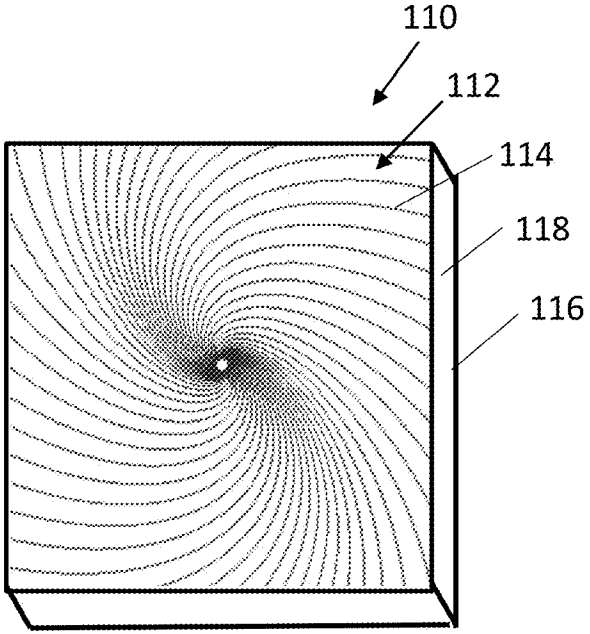
FIG. 5 shows a flat panel arrangement of the twistarray reflector.

Referring now to FIG. 5, a twistarray reflector 110 using the techniques taught above can be implemented in a flat panel arrangement having a front surface 112 comprising wires 114 and a back reflecting surface 116, the front surface 112 fabricated from the wires 114 and composites 118 where the wires 114 are placed having an orientation at each point on the front surface 112 to decompose an incident field into orthogonal components so that an electromagnetic field reflected from the front surface 112 when superposed with a phase-inverted electromagnetic field reflected from the back reflecting surface 116 produces a net reflected electromagnetic field that is polarized in a specific vector direction with consistent phase.

Referring now to FIG. 5A, a twistarray reflector 120 using the techniques taught above can be implemented in a curved panel arrangement having a front surface 122 comprising wires 124 and a back reflecting surface 126, the front surface 122 fabricated from the wires 124 and composites 128 where the wires 124 are placed having an orientation at each point on the front surface 122 to decompose an incident field into orthogonal components so that an electromagnetic field reflected from the front surface 122 when superposed with a phase-inverted electromagnetic field reflected from the back reflecting surface 126 produces a net reflected electromagnetic field that is polarized in a specific vector direction with consistent phase.

Figures 6, 6A, 6B:
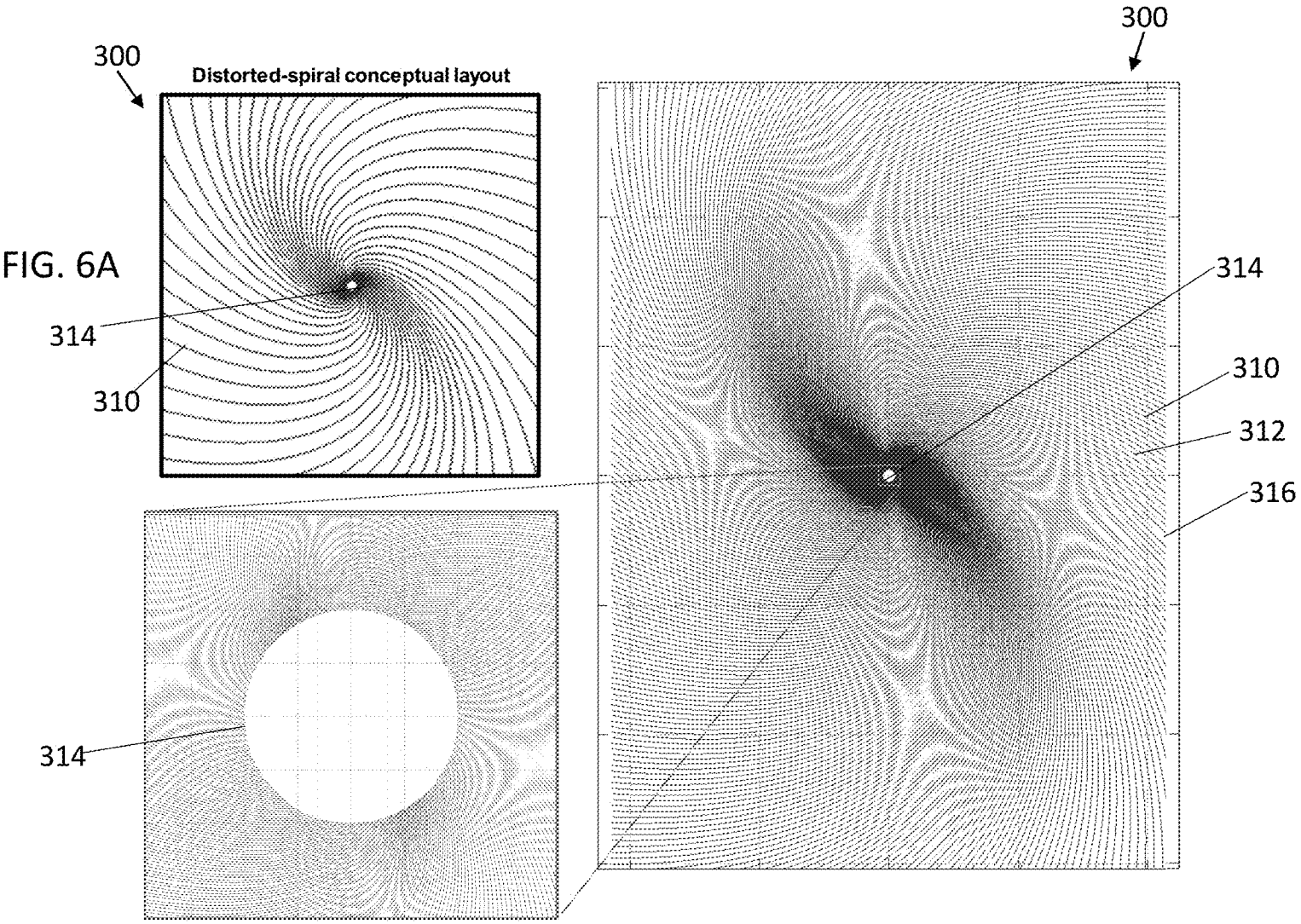
FIG. 6 shows a Variable Twistarray Reflector for Axisymmetric Incident Fields.
FIG. 6A shows trace paths in a distorted-spiral enlarged view of a layout of wire paths extending from an outer periphery to an inner ring of a variable twistarray reflector.
FIG. 6B shows an enlarged view of the inner ring of the variable twistarray reflector.

Referring now to FIG. 6, a variable twistarray reflector 300 for axisymmetric incident fields is shown. This disclosure relates to methods and apparatus for a variable twistarray reflector 300 capable of altering the polarization of an incident axisymmetric electromagnetic (EM) field distribution to any elliptical polarization at each point in the EM distribution. Specific cases of interest are: 1) reproducing the original axisymmetric polarization distribution about the reflected direction, 2) the EM dual of this polarization distribution, and 3) circular polarization of either chirality. Specifically, the disclosure transforms a radiated axisymmetric $TE_{01}$ circular EM-field distribution to the form of a radiated axisymmetric $TM_{01}$ circular EM-field distribution, and vice versa, and any elliptical polarization in between, including circular polarization. Additionally, the disclosure can rapidly adapt to any narrowband frequency over an ultrawideband range of frequencies. The disclosure can handle extremely high power, making it suitable for high-power microwave (HPM) applications.

The variable twistarray reflector 300 for axisymmetric incident fields leverages the concepts of an ordinary twistarray reflector but extends them in two different ways. First, at every point on the wire-array reflector surface, the wire path is treated as a continuous function that can be manipulated mathematically to render a required geometry (not necessarily parallel linear) to produce a particular effect. For an incident axisymmetric EM-field distribution of polarizations (either TE or TM), the wire paths are chosen so that the reflected distribution is the EM dual of the polarization distribution that would have occurred (TM or TE) if the incident polarization distribution had been reflected by the conductive back plane alone. Secondly, the Variable Twistarray Reflector for Axisymmetric Incident Fields provides the ability to dynamically vary the spacing between the front-surface wire array and back-surface conducting sheet. As the difference in path length increases from zero, the phase delay of fields reflected from the back plane increases relative to the phase of fields reflected from the wire array, so that the polarization of the recombined reflected EM field at each point changes successively from:

Right or left circular ($\Delta\psi_{delay}=-\tau/4+n\tau$), to

Linear co-polarized with the incident field ($\Delta\psi_{delay}=n\tau$) to

Left or right circular ($\Delta\psi_{delay}=\tau/4+n\tau$) to

Linear cross-polarized with the incident field ($\Delta\psi_{delay}=\tau/2+n\tau$)

repeating cyclically for n=0, 1, 2, . . . , where $\tau=2\pi$ (one wave cycle per $\tau$ radians). The spatial distance corresponding to the phase delay depends on the wavelength, hence frequency. Consequently, the capability to dynamically vary the spacing between the wire array and the back plane also, with appropriate control software, gives the variable twistarray reflector 300 for axisymmetric incident fields the capability to achieve any polarization at a desired frequency over any bandwidth for which the traces remain dense enough for the highest frequency in the band of interest. The high-purity incident axisymmetric EM-field distribution may be prepared for this disclosure using the techniques described below.

Referring now also to FIGS. 6A and 6B, the variable twistarray reflector 300 is based on the conceptual physics that underpins an ordinary twistarray reflector but extends these concepts to a different design format and applies the concepts in a manner not formerly considered for legacy twistarray reflectors. In the variable Twistarray Reflector for Axisymmetric Incident Fields construction, the simple format of constraining wires to parallel planes is replaced by the concept of aligning the wires with the streamlines of the abstracted wire-direction mathematical vector field. This wire-direction vector field is the mathematical solution that results from directly imposing the following requirement on reflected EM fields:

Choose a wire orientation at each point on the front reflecting surface that decomposes the incident field into orthogonal components so that the EM field reflected from the front surface, when superposed with the phase-inverted EM field reflected from the back surface, produces a net reflected EM field that is polarized orthogonal to the EM field that would have been reflected by the back surface alone.

In the particular case of an axisymmetric incident EM field distribution, the abstracted wire-direction mathematical vector field is conveniently described as a continuous function of cylindrical-polar coordinates, implying that the stream lines curve over the reflector surface in paths that vary with radius and azimuth. Wires forming the wire array in this wire-direction vector field construction may be placed anywhere on the surface, but once any point on a wire path is designated, the wire path must follow that stream line in the wire-direction vector field.

One embodiment of a variable twistarray reflector 300 designed for non-normal incidence, has been implemented in hardware and has been demonstrated to function electromagnetically as intended. The raw conceptual wire paths in this embodiment are shown as 2D graphs in FIG. 6. FIG. 6 shows conceptual trace paths of a variable twistarray reflector 300. FIG. 6A shows trace paths 310 in a distorted-spiral enlarged view of a layout of wire paths 310 extending from an outer periphery to an inner ring 314 of the variable twistarray reflector 300. FIG. 6B shows an enlarged view of the inner ring 314 of the variable twistarray reflector 300. A line 312 identifies the path of a single trace (same trace is marked in the full and enlarged views). Trace paths (wires) 310 of the variable twistarray reflector 300 extend from an outer periphery 316 to an inner ring 314. Determining the conceptual wire path is the first step to creating a physical instantiation of a variable twistarray reflector 300. To construct conductive circuit-board traces (the wires) on the conceptual paths, the following additional information must be provided:

1. Each conceptual trace path is bounded by a continuous curve on either side to demarcate a metal trace of finite width, with the conceptual trace path nominally centered between these boundaries.
2. The width-to-separation ratio of all traces must remain nearly constant over all resolutions.
3. The trace width cannot anywhere become thinner than the minimum trace width specified by the circuit board fabricator.
4. Spacing between successive traces should not exceed $\lambda/10$ at the highest frequency of the operational band in any region of significant illumination by the incident beam.

5. The sequence of points describing each trace must form a closed path in the circuit board plane so that the fabrication software understands the point cloud as a trace.
6. The sampling resolution must be sufficient to accurately represent the curving trace boundaries without introducing spurious gaps or thinning of the trace width in any region due to inaccurate interpolation.
7. Trace tips approaching the axisymmetric center are shorted together in a center ring to preclude E-field-induced breakdown from charge accumulating at the ends of the traces.
8. Trace tips at the outer edge are terminated with a region of enhanced radius to mitigate field-induced breakdown from charge accumulating at the tips.

Figures 7, 7A, 7B, 7C:
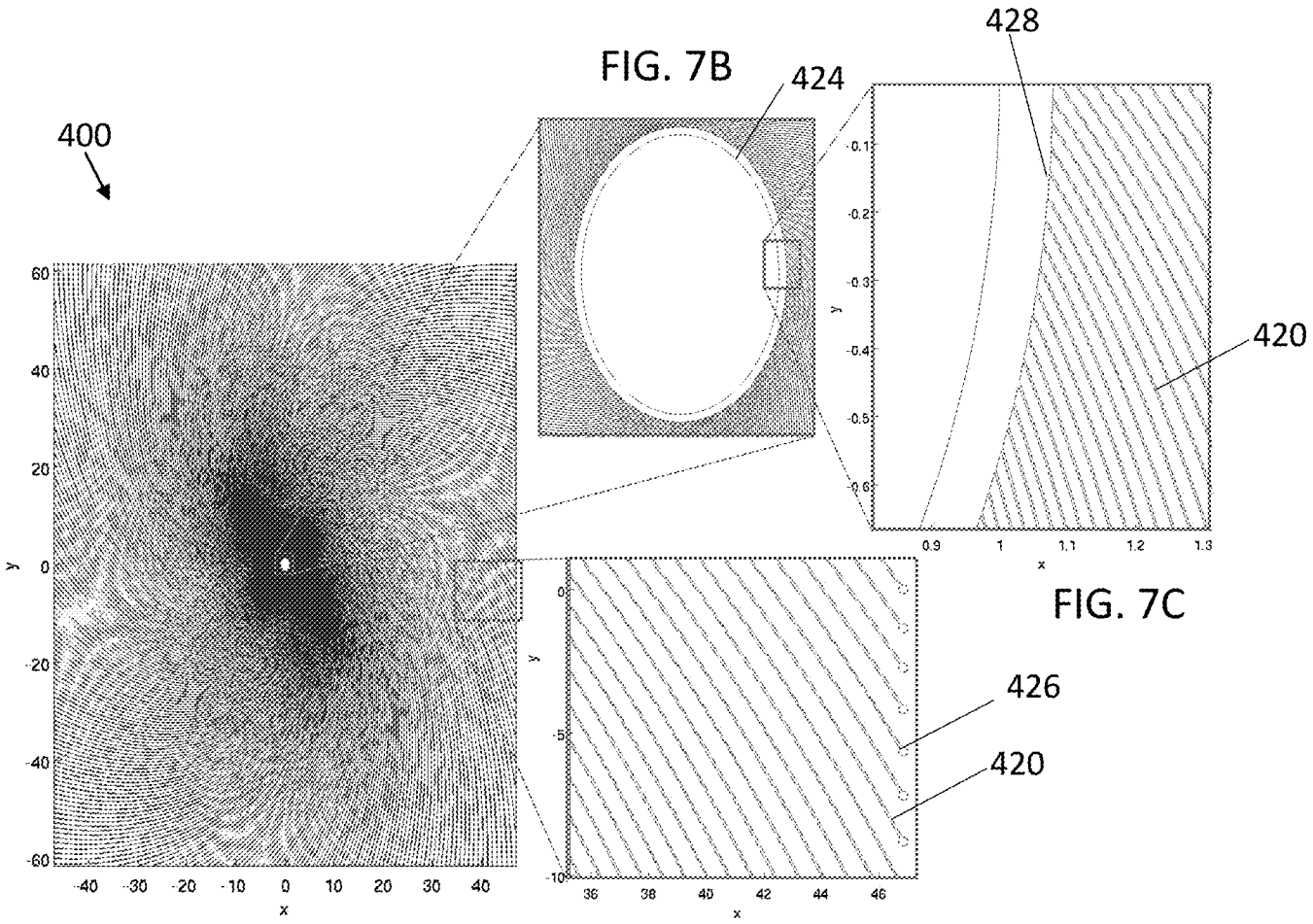
FIG. 7 shows a plot of the point clouds specifying the trace boundaries of the Variable Twistarray Reflector for Axisymmetric Incident Fields.
FIG. 7A shows enhanced-radius tips of the traces of the variable twistarray reflector.
FIG. 7B shows an enhanced view of the connecting conducting inner ring.
FIG. 7C shows an enhanced view of the inner ends of the traces of the variable twistarray reflector.

These features are illustrated in FIG. 7 for the same embodiment of a variable twistarray reflector 400 for axisymmetric incident fields. The shape of the inner ring 424 is elliptical because in this case the reflector lies at constant 45° slope relative to the axisymmetric beam. Notice that the traces are functionally self-similar at all locations and size scales. The mathematical description and the numerical manipulations required to generate these trace paths for non-normal incidence are non-trivial. To handle the huge range of resolutions required, the sampling density of points used to resolve each trace path is determined by the local curvature of the conceptual wire path locating the trace. FIG. 7 shows a plot of the point clouds specifying the trace boundaries of the variable twistarray reflector 400 used to create the specification file for fabrication. Successive levels of magnification of inner and outer regions of FIG. 7 show the connecting conducting inner ring 424 and inner ends 428 of the wire paths 420 (FIGS. 7B and 7C) and the enhanced-radius tips 426 of the traces or wire paths 420 (FIG. 7A). These trace details inhibit E-field-induced breakdown at the inner and outer ends of the continuous conductive paths formed by the traces.

To arrange for a dynamically variable separation distance between the wire-array surface and the back-plane surface, the dielectric substrate of traces must lie on the incident side of the traces for two reasons. First, the separation between the traces and the conductive back plane must be allowed to collapse to zero so that the traces vanish electrically in the case that no twist in the polarization is desired. Second, with variable phase delay in the separation, any additional static phase delay due to the dielectric substrate and foam support (A-sandwich or otherwise) must be common to both the wave-component reflected from the traces and from the wave-component reflected from the back plane.

Figure 8A:
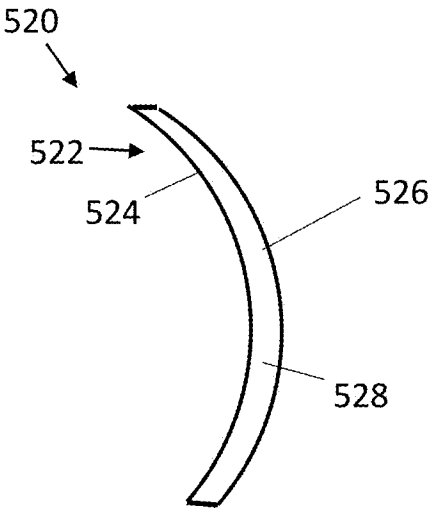
FIG. 8A shows a curved panel arrangement of the twistarray reflector.
Figure 8:
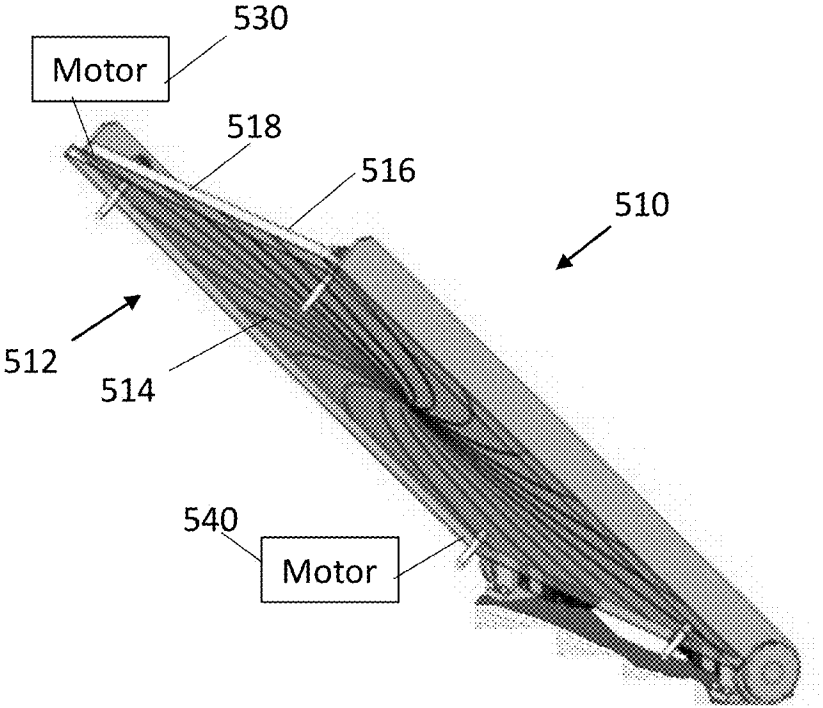
FIG. 8 shows a flat panel arrangement of the variable twistarray reflector.

Referring now to FIG. 8, a variable twistarray reflector 510 using the techniques taught above can be implemented in a flat panel arrangement having a front surface 512 comprising wires 514 and a back reflecting surface 516, the front surface 512 fabricated from the wires 514 and composites 518 where the wires 514 are placed having an orientation at each point on the front surface 512 to decompose an incident field into orthogonal components so that an electromagnetic field reflected from the front surface 512 when superposed with a phase-inverted electromagnetic field reflected from the back reflecting surface 516 produces a net reflected electromagnetic field that is polarized in a specific vector direction with consistent phase. The variable twistarray reflector 510 includes a motor 530 to vary the distance between the front surface 512 and the back reflecting surface 516 to implement the technique described above. The variable twistarray reflector 510 also includes a motor 540 to apply tension on the wires 514 to vary the disposition of the wires 514 to implement the technique described above.

Referring now to FIG. 8A, a variable twistarray reflector 520 using the techniques taught above can be implemented in a curved panel arrangement having a front surface 522 comprising wires 524 and a back reflecting surface 526, the front surface 522 fabricated from the wires 524 and composites 528 where the wires 524 are placed having an orientation at each point on the front surface 522 to decompose an incident field into orthogonal components so that an electromagnetic reflected from the front surface 522 when superposed with a phase-inverted electromagnetic field reflected from the back reflecting surface 526 produces a net reflected electromagnetic field that is polarized in a specific vector direction with consistent phase. Similar to FIG. 8, the variable twistarray reflector 520 includes a motor (not shown) to vary the distance between the front surface 522 and the back reflecting surface 526 to implement the technique described above and a motor (not shown) to apply tension on the wires 524 to vary the disposition of the wires 524 to implement the technique described above.

As described above and will be appreciated by one of skill in the art, embodiments of the disclosure herein may be configured as a system, method, or combination thereof. Accordingly, embodiments of the present disclosure may be comprised of various means including hardware, software, firmware or any combination thereof. Furthermore, embodiments of the present disclosure may take the form of a computer program product on a computer-readable storage medium having computer readable program instructions (e.g., computer software) embodied in the storage medium. Any suitable non-transitory computer-readable storage medium may be utilized.

All references cited herein are hereby incorporated herein by reference in their entirety.

While electronic circuits shown in figures herein may be shown in the form of analog blocks or digital blocks, it will be understood that the analog blocks can be replaced by digital blocks that perform the same or similar functions and the digital blocks can be replaced by analog blocks that perform the same or similar functions. Analog-to-digital or digital-to-analog conversions may not be explicitly shown in the figures but should be understood.

Having described preferred embodiments, it will now become apparent to one of ordinary skill in the art that other embodiments incorporating their concepts may be used. For example, it will also be appreciated that while the circuits and techniques are shown and described herein in connection with analog circuitry, alternatively digital circuitry and techniques can be used for some or all of the circuit functions.

Elements of different embodiments described herein may be combined to form other embodiments not specifically set forth above. Various elements, which are described in the context of a single embodiment, may also be provided separately or in any suitable subcombination. Other embodiments not specifically described herein are also within the scope of the following claims.

It is felt therefore that these embodiments should not be limited to disclosed embodiments, but rather should be limited only by the spirit and scope of the appended claims.

What is claimed is:

1. A twistarray reflector comprising:

a first reflective surface comprising a trace path of distorted-spiral wires disposed about a center ring and extending to a periphery of the first reflective surface; and a back reflecting surface disposed a distance from the first reflective surface, wherein each one of the distorted-spiral wires has a trace tip where the trace tips approaching an axisymmetric center are shorted together in the center ring to preclude E-field-induced breakdown from charge accumulating at ends of the traces.

2. The twistarray reflector as recited in claim 1 wherein each one of the distorted-spiral wires has a conceptual trace path and each conceptual trace path is bounded by a continuous curve on either side to demarcate a metal trace of finite width, with the conceptual trace path nominally centered between these boundaries.

3. The twistarray reflector as recited in claim 1 wherein each one of the distorted-spiral wires has a width-to-separation ratio of all trace paths remain nearly constant over all resolutions.

4. The twistarray reflector as recited in claim 1 wherein each one of the distorted-spiral wires has a trace width not less than a minimum trace width of a circuit board.

5. The twistarray reflector as recited in claim 1 wherein spacing between successive distorted-spiral wires do not exceed $\lambda/10$ at the highest frequency of an operational band in any region of significant illumination by an incident beam.

6. The twistarray reflector as recited in claim 1 wherein each one of the distorted-spiral wires has a sampling resolution sufficient to accurately represent curving trace boundaries of the trace path without introducing spurious gaps or thinning of a trace width in any region due to inaccurate interpolation.

7. The twistarray reflector as recited in claim 1 wherein the distance between the first reflective surface and the back reflective surface can be varied.

8. The twistarray reflector as recited in claim 7 comprising a motor to vary the distance between the first reflective surface and the back reflective surface.

9. The twistarray reflector as recited in claim 1 wherein the distorted-spiral wires are moveable.

10. The twistarray reflector as recited in claim 9 comprising a motor to move the distorted-spiral wires.

11. A twistarray reflector comprising:

a first reflective surface comprising a trace path of distorted-spiral wires disposed about a center ring and extending to a periphery of the first reflective surface; and a back reflecting surface disposed a distance from the first reflective surface, wherein each one of the distorted-spiral wires has a trace tip where the trace tips at an outer edge are terminated with a region of enhanced radius to mitigate field-induced breakdown from charge accumulating at the tips.

12. The twistarray reflector as recited in claim 11 wherein each one of the distorted-spiral wires has a conceptual trace path and each conceptual trace path is bounded by a continuous curve on either side to demarcate a metal trace of finite width, with the conceptual trace path nominally centered between these boundaries.

13. The twistarray reflector as recited in claim 11 wherein each one of the distorted-spiral wires has a width-to-separation ratio of all trace paths remain nearly constant over all resolutions.

14. The twistarray reflector as recited in claim 11 wherein each one of the distorted-spiral wires has a trace width not less than a minimum trace width of a circuit board.

15. The twistarray reflector as recited in claim 11 wherein spacing between successive distorted-spiral wires do not exceed $\lambda/10$ at the highest frequency of an operational band in any region of significant illumination by an incident beam.

16. The twistarray reflector as recited in claim 11 wherein each one of the distorted-spiral wires has a sampling resolution sufficient to accurately represent curving trace boundaries of the trace path without introducing spurious gaps or thinning of a trace width in any region due to inaccurate interpolation.

* * * * *